US011400738B2

(12) United States Patent
Yamamoto

(10) Patent No.: US 11,400,738 B2
(45) Date of Patent: Aug. 2, 2022

(54) IMAGE PROCESSING APPARATUS

(71) Applicant: TOSHIBA TEC KABUSHIKI KAISHA, Tokyo (JP)

(72) Inventor: Mikio Yamamoto, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 102 days.

(21) Appl. No.: 16/828,846

(22) Filed: Mar. 24, 2020

(65) Prior Publication Data

US 2021/0300089 A1 Sep. 30, 2021

(51) Int. Cl.
*B41J 15/04* (2006.01)

(52) U.S. Cl.
CPC ..... *B41J 15/044* (2013.01)

(58) Field of Classification Search
None
See application file for complete search history.

(56) References Cited

U.S. PATENT DOCUMENTS 4,487,406 A * 12/1984 Kabashima ..... B65H 1/04 271/127
6,820,872 B2 * 11/2004 Ko ..... B65H 1/00 221/287
9,310,752 B2 * 4/2016 Hiura ..... F16H 21/44
2006/0180996 A1 * 8/2006 Iwase ..... G03G 15/6502 271/162
2011/0031681 A1 * 2/2011 Miki ..... G03G 15/6552 271/121

* cited by examiner

*Primary Examiner* — Matthew G Marini
(74) *Attorney, Agent, or Firm* — Foley & Lardner LLP

(57) ABSTRACT

An image processing apparatus includes an apparatus body, a feeding cassette, a pin member, a lever, an elastic member, and a guide mechanism. The feeding cassette is insertable into and ejectable from the apparatus body in one direction and includes an insertion position for insertion into the apparatus body and an ejection position for ejection from the apparatus body. The pin member is connected to the feeding cassette. The lever is rotatable around an axis in a first direction, and includes a pin engagement portion engaging with the pin member at a tip end in the axial direction. The elastic member includes a tip end connected between the rotation axis of the lever and the pin engagement portion of the lever, and adds a force for rotation in an insertion direction. The guide mechanism shortens a distance between the pin member and the rotation axis of the lever.

8 Claims, 8 Drawing Sheets

IMAGE PROCESSING APPARATUS

FIELD

Embodiments described herein relate generally to an image processing apparatus.

BACKGROUND

In image processing apparatuses that form images on sheets or erase images formed on sheets, feeding cassettes that are detachably mounted on apparatus bodies and accommodate sheets before processes are provided.

DETAILED DESCRIPTION

In some apparatuses, when loading amounts of sheets are large, the feeding cassettes become heavy and loads are imposed on users when the users insert or eject the feeding cassettes to mount or detach the feeding cassettes on or from the apparatus bodies.

In general, according to at least one embodiment, there is provided an image processing apparatus including an apparatus body, a feeding cassette, a pin member, a lever, an elastic member, and a guide mechanism. The feeding cassette is provided to be insertable into and ejectable from the apparatus body in one direction and is configured to include an insertion position for insertion into the apparatus body and an ejection position for ejection from the apparatus body. The pin member is formed in a shape with an axis and is connected to the feeding cassette in a first direction in which an axial direction is orthogonal to an insertion and ejection direction to be relatively movable in a second direction orthogonal to the insertion and ejection direction and the first direction. The lever is formed in a shape with an axis, is provided to be rotatable around a rotation axis in the first direction, and includes a pin engagement portion engaging with the pin member at a tip end in the axial direction. The pin engagement portion includes a first contact surface in an ejection direction. The elastic member is formed in a shape with an axis, is configured so that a tip end in an axial direction is connected between the rotation axis of the lever and the pin engagement portion of the lever, adds a force for rotation in an insertion direction to the pin engagement portion of the lever, and brings the pin member into contact with the first contact surface of the lever to add a force in the insertion direction to the pin member. The guide mechanism is configured to shorten a distance between the pin member and the rotation axis of the lever when the feeding cassette is transitioned from the ejection position to the insertion position more than the distance when the feeding cassette is transitioned from the insertion position to the ejection position.

Hereinafter, an image processing apparatus according to an embodiment will be described with reference to the drawings.

In the following description, a depth direction is referred to as the X axis direction. The right and left direction is referred to as the Y axis direction. The upper and lower direction is referred to as the Z axis direction. The depth direction, the right and left direction, and the upper and lower direction are orthogonal to one another. A direction of an arrow X is a front side and an opposite side of the direction of the arrow X, which is the rear side. A direction of an arrow Y is the right side and an opposite side of the direction of the arrow Y, which is the left side. A direction of an arrow Z is the upper side and an opposite side of the direction of the arrow Z, which is the lower side.

Figure 1:
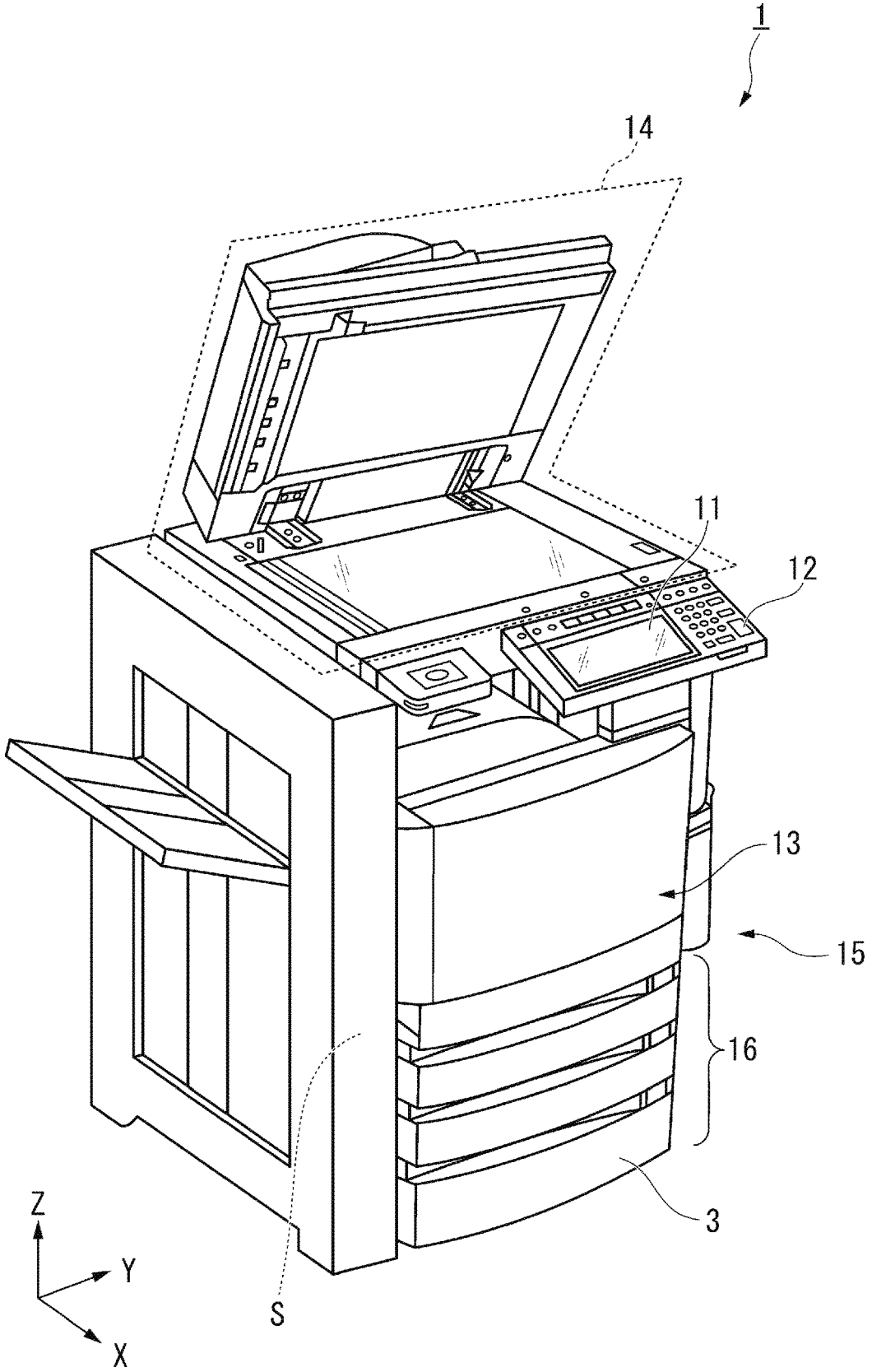
FIG. 1 is a perspective view illustrating an image processing apparatus according to at least one embodiment.

FIG. 1 is a perspective view illustrating an image processing apparatus 1 according to an embodiment. The image processing apparatus 1 according to at least one embodiment is, for example, an image forming apparatus such as a copy machine or a multi-function printer (MFP). Hereinafter, an example of the image processing apparatus 1 according to at least one embodiment illustrated in FIG. 1 will be described.

As illustrated in FIG. 1, the image processing apparatus 1 includes a display 11, a control panel unit 12, an image forming unit 13, an image reader 14, an apparatus body 15, and a sheet storage 16.

The display 11 and the control panel unit 12 are used to check and input operation content when a user operates the image processing apparatus 1. The image forming unit 13 forms an image on a sheet. The image reader 14 digitizes text or an image printed on a sheet.

Figure 2:
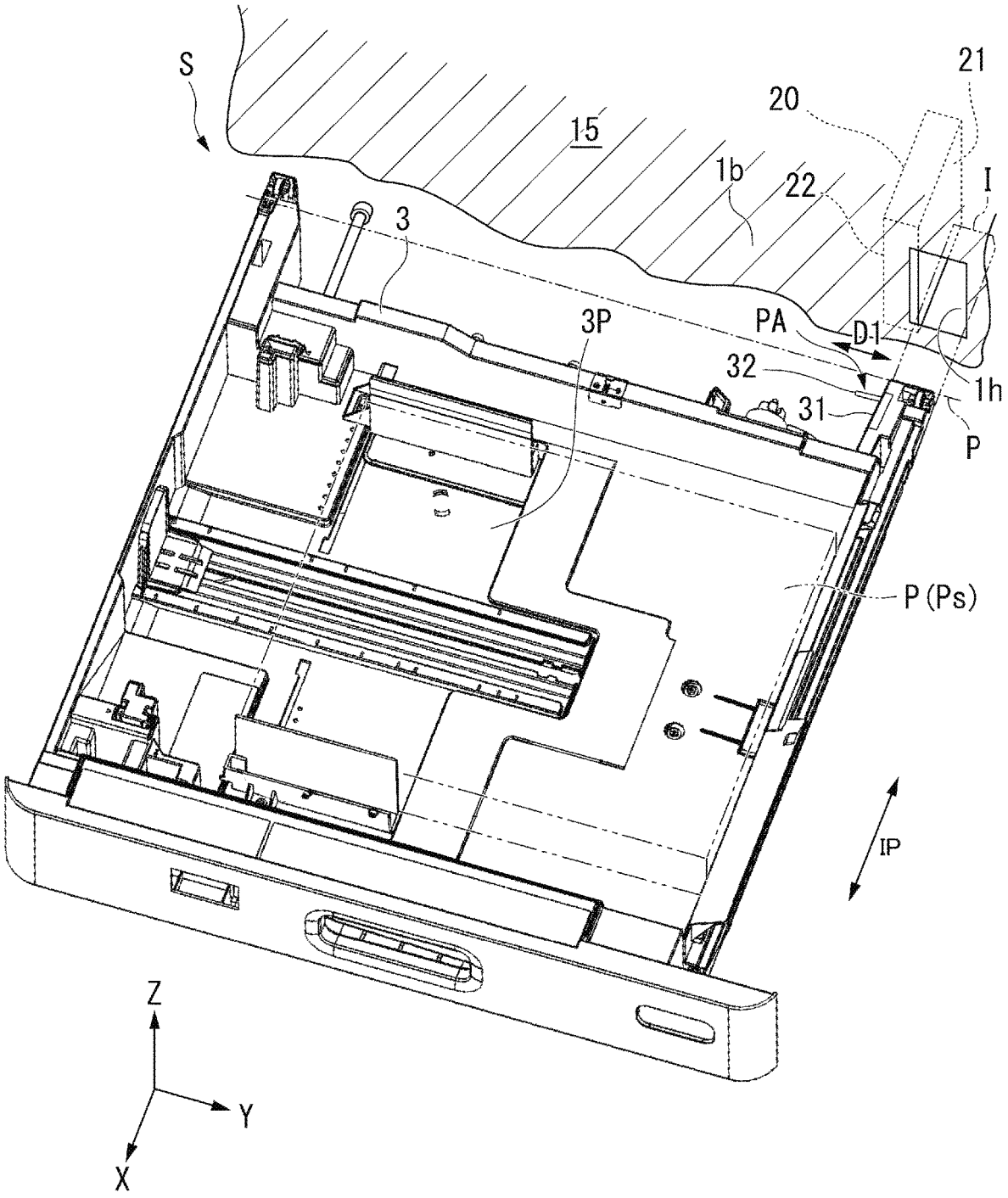
FIG. 2 is a perspective view illustrating a lower space of the body of the image processing apparatus according to at least one embodiment.

The apparatus body 15 is a casing that contains the display 11, the control panel unit 12, the image forming unit 13, the image reader 14, and the sheet storage 16. The apparatus body 15 contains the sheet storage 16 in a lower space S. The sheet storage 16 includes a feeding cassette 3. FIG. 2 is a perspective view illustrating the lower space S of the apparatus body 15. In FIG. 2, the others are not illustrated except for one feeding cassette 3 included in the sheet storage 16.

As illustrated in FIG. 2, the apparatus body 15 includes an inner surface 1*b* and a feeding cassette pull-in mechanism 20. The inner surface 1*b* is a surface facing on the front side in the depth direction. The inner surface 1*b* is a surface of the inner side of the apparatus body 15 and faces the lower space S. An introduction hole 1*h* is formed in the inner surface 1*b*. The introduction hole 1*h* penetrates through the inner surface 1*b* and is substantially rectangular in a front view. The introduction hole 1*h* allows a part of the feeding cassette 3 to pass when the feeding cassette 3 is inserted into the apparatus body 15.

The feeding cassette pull-in mechanism 20 adds a force of insertion into the apparatus body 15 to the feeding cassette 3. The feeding cassette pull-in mechanism 20 is connected to the rear side of the inner surface 1*b* of the apparatus body 15.

Figure 3:
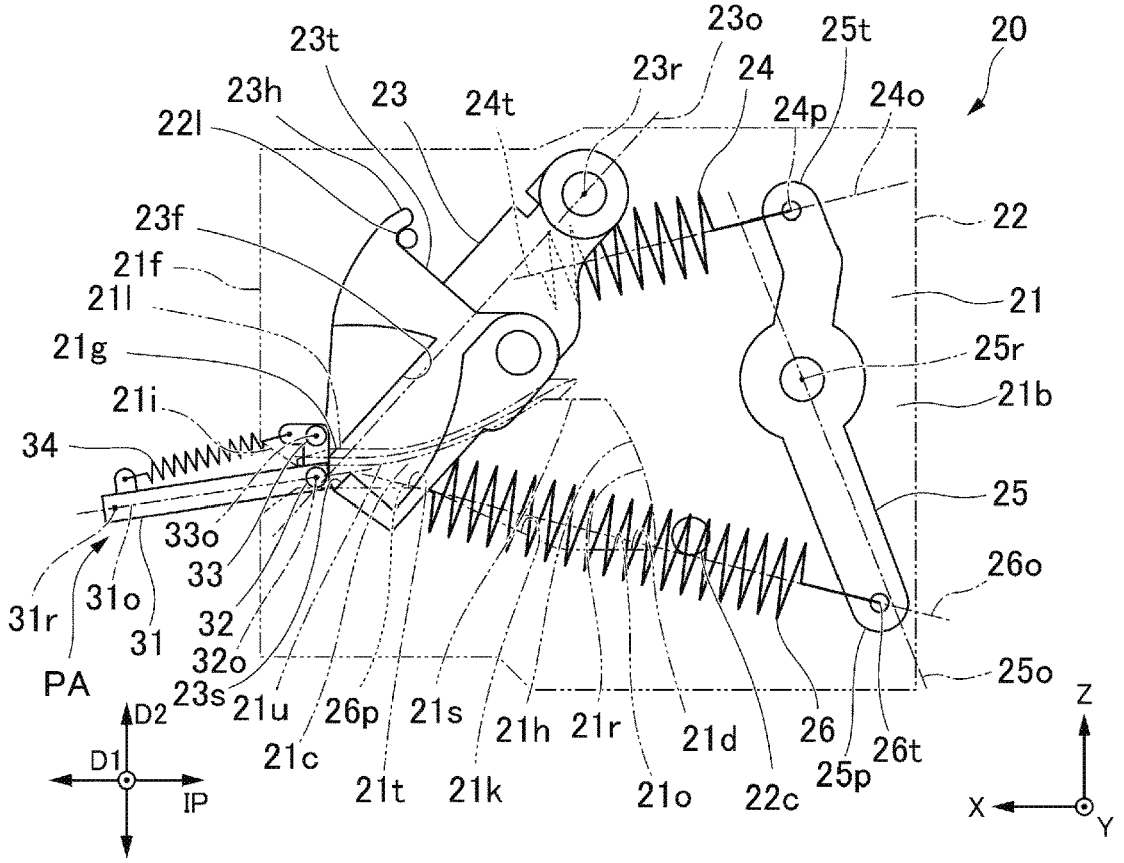
FIG. 3 is a side view illustrating a pull-in end and a feeding cassette pull-in mechanism included in the image processing apparatus according to at least one embodiment.

FIG. 3 is a side view illustrating the feeding cassette pull-in mechanism 20. As illustrated in FIG. 3, the feeding cassette pull-in mechanism 20 includes a chassis 21, a cover 22, a lever 23, an elastic member 24, an auxiliary lever 25, and an auxiliary elastic member 26.

The chassis 21 has a substantially planar shape (e.g., a plate shape). In the chassis 21, a plate surface 21*b* is connected to the inner surface 1*b* of the apparatus body 15 orthogonally in the right and left direction. As illustrated in FIG. 2, the plate surface 21*b* overlaps the introduction hole 1*h* in the front view.

As illustrated in FIG. 3, an introduction groove 21*i* is formed at a front-side end 21*f* of the plate surface 21*b* of the chassis 21. In the introduction groove 21*i*, an interval of an edge is narrowed toward the rear side.

In the plate surface 21*b* of the chassis 21, a guide hole 21*h* extending from the introduction groove 21*i* to the rear side is formed. The guide hole 21*h* forms a part of an edge in which an upper-side edge 21*u*, a rear-side edge 21*r*, and a lower-side edge 21*d* continue, and communicates with the introduction groove 21*i*.

In the guide hole 21*h*, the upper-side edge 21*u* includes a curved portion 21*c* and a straight portion 21*s*. The curved portion 21*c* extends to the rear side from the end of the edge of the introduction groove 21*i* on the rear side and extends to the upper side toward the rear side in a protrusion shape downwards in a side view. The straight portion 21*s* extends to the rear side from the end of the curved portion 21*c* on the rear side and is formed in the depth direction.

The rear-side edge 21*r* of the guide hole 21*h* extends to the lower side from the end of the straight portion 21*s* on the rear side and extends to the rear side toward the lower side in a protrusion shape on the rear side in the side view.

The lower-side edge 21*d* of the guide hole 21*h* includes a first straight portion 21*o*, an inclined portion 21*k*, and a second straight portion 21*t*. The first straight portion 21*o* extends to the front side from the end of the rear-side edge 21*r* on the lower side and is formed in the depth direction. The inclined portion 21*k* extends to the front side from the end of the first straight portion 21*o* on the front side and extends to the upper side toward the front side. The second straight portion 21*t* extends to the front side from the end of the inclined portion 21*k* on the front side and is formed in the depth direction. The end of the second straight portion 21*t* on the front side is connected to the end of the edge of the introduction groove 21*i* on the rear side.

The guide hole 21*h* has a dimension in the upper and lower direction which increases toward the rear side up to the end of the straight portion 21*s* on the rear side. Accordingly, the size of the guide hole varies in at least one dimension, such that the span of the guide hole at one position closer to the end of the straight portion 21*s* is less than at a second position farther from the end of the straight portion 21*s*.

The guide hole 21*h* includes a rib 21*l* that protrudes toward the right in the upper-side edge 21*u*. The rib 21*l* is formed from the curved portion 21*c* of the upper-side edge 21*u* to the center of the straight portion 21*s* in the depth direction. In the rib 21*l*, a groove 21*g* opened on the upper side is formed in the entire length in the depth direction.

The cover 22 has a substantially box shape with an opening. The cover 22 is joined to the plate surface 21*b* so that the edge of the opening of the cover 22 matches the edge of the plate surface 21*b*. The cover 22 is joined to the plate surface 21*b* from the back. The cover 22 includes a locking portion 22*l* on the upper side of the front side. The locking portion 22*l* has a columnar shape with a shaft along the right and left direction. The cover 22 includes a contact portion 22*c* on the lower side of the rear side. The contact portion 22*c* has a columnar shape with a shaft along the right and left direction.

The lever 23 is formed in a shape with an axis and is formed in, for example, a substantially plate shape. A base end of the lever 23 is connected to the chassis 21 and the cover 22 to be rotatable around a rotation axis 23*r* in the right and left direction. The lever 23 is connected to the chassis 21 and the cover 22 so that an axis 23*o* is formed along a plane including the depth direction and the upper and lower direction. The rotation axis 23*r* is disposed substantially at the center of the chassis 21 and the cover 22 in the depth direction. The rotation axis 23*r* is disposed on the upper side of the chassis 21 and the cover 22 in the upper and lower direction.

The lever 23 includes a pin engagement portion 23*t* at the tip end. The pin engagement portion 23*t* includes a first contact surface 23*f* and a second contact surface 23*s* along the axis 23*o* and in the right and left direction. The first contact surface 23*f* and the second contact surface 23*s* substantially oppose each other with the axis 23*o* interposed therebetween. The first contact surface 23*f* is disposed on the front side. The second contact surface 23*s* is disposed on the rear side.

The lever 23 includes a hook 23*h* in the pin engagement portion 23*t*. The hook 23*h* is provided at a position more distant than the first contact surface 23*f* from the axis 23*o* and close to the rotation axis 23*r*.

The elastic member 24 is formed in a shape with an axis and is, for example, a coil spring. In the elastic member 24, a tip end in the direction of an axis 24*o* is connected between the rotation axis 23*r* and the pin engagement portion 23*t* of the lever 23.

The auxiliary lever 25 is formed in a shape with an axis and is formed in, for example, a substantially plate shape. The auxiliary lever 25 is connected to the chassis 21 and the cover 22 to be rotatable around a rotation axis 25*r* in the right and left direction. The auxiliary lever 25 is connected to the chassis 21 and the cover 22 so that an axis 25*o* is formed along a plane extending along the depth direction and the upper and lower directions. The auxiliary lever 25 is disposed on the rear side from the lever 23. The rotation axis 25*r* is disposed on the rear side of the chassis 21 and the cover 22 in the depth direction. The rotation axis 25*r* is disposed substantially at the center of the chassis 21 and the cover 22 with respect to the upper and lower directions.

In the auxiliary lever 25, a base end 24*p* opposite to a tip end 24*t* of the elastic member 24 in the direction of the axis 24*o* is connected to a tip end 25*t* in the direction of the axis 25*o*. The tip end 25*t* is disposed above the rotation axis 25*r*.

The auxiliary elastic member 26 is formed in a shape with an axis and is, for example, a coil spring. In the auxiliary elastic member 26, a tip end 26*t* in the direction of an axis 26*o* is connected to a base end 25*p* opposite to the tip end 25*t* in the direction of the axis 25*o* of the auxiliary lever 25. In the auxiliary elastic member 26, a base end 26*p* opposite to the tip end 26*t* in the direction of the axis 26*o* is connected to the front side of the cover 22.

In a state in which the feeding cassette pull-in mechanism 20 does not operate, the hook 23*h* of the lever 23 is locked to the locking portion 22*l* of the cover 22. In the state in which the feeding cassette pull-in mechanism 20 does not operate, the elastic member 24 and the auxiliary elastic member 26 are in a pull-in state. In the state in which the feeding cassette pull-in mechanism 20 does not operate, a force and a moment applied to the lever 23, the elastic member 24, the auxiliary lever 25, and the auxiliary elastic member 26 are balanced.

The feeding cassette 3 is inserted into and ejected from the apparatus body 15. In the feeding cassette 3, an insertion and ejection direction IP is oriented in the depth (longitudinal) direction (the Y axis direction). The feeding cassette 3 has an ejection position P at which the feeding cassette 3 is ejected from the apparatus body 15 on the front side and an insertion position I at which the feeding cassette 3 is inserted into the apparatus body 15 on the rear side. The feeding cassette 3 is formed in a box shape that has a placement surface 3P which is a bottom surface and is open upward, as illustrated in FIG. 2. In the feeding cassette 3, a sheet P is stacked on the placement surface 3P in the upper and lower direction and a sheet bundle Ps having a stack height equal to or less than a maximum stack height is placed.

The feeding cassette 3 includes a pull-in end PA. The pull-in end PA is disposed at the end of the feeding cassette 3 on the rear side. FIG. 3 is a side view illustrating the pull-in end PA. As illustrated in FIG. 3, the pull-in end PA includes a link member 31, a pin member 32, a guide pin 33, and an urging member 34.

The link member 31 is formed in a shape with an axis 31*o* and is formed in, for example, a planar shape such as a plate shape. The link member 31 is connected to the feeding cassette 3 to be rotatable around a rotation axis 31*r* in the right and left direction. The link member 31 is connected to the feeding cassette 3 so that the axis 31*o* is formed along a plane including the insertion and ejection direction IP and the upper and lower direction.

The pin member 32 is formed in a shape with an axis 32*o* and is formed in, for example, a columnar shape. The pin member 32 is connected to the tip end of the link member 31 so that a first direction D1 which is the direction of the axis 32*o* is orthogonal to the insertion and ejection direction IP. In the embodiment, the first direction D1 is oriented in the right and left direction (the Y axis direction). The pin member 32 is moved with respect to the feeding cassette 3 with rotation of the link member 31 in a second direction D2 orthogonal to the insertion and ejection direction IP and the first direction D1. In the embodiment, the second direction D2 is oriented in the upper and lower direction (the Z axis direction).

The guide pin 33 is formed in a shape with an axis and is formed in, for example, a columnar shape. The guide pin 33 is connected to the pin member 32 to be rotatable around the pin member 32 so that an axis 33*o* is formed in the right and left direction. At the tip end of the guide pin 33, a cylindrical roller 33*r* is externally fitted in the guide pin 33. The roller 33*r* is externally fitted in the guide pin 33 to be rotatable around the axis 33*o* of the guide pin 33.

The urging member 34 urges the guide pin 33 so that the guide pin 33 is disposed above the pin member 32.

The guide hole 21*h* of the chassis 21, and the link member 31, the guide pin 33, and the urging member 34 of the pull-in end PA form a guide mechanism that guides movement of the pin member 32 in the depth direction and the upper and lower direction.

Next, an operation of the feeding cassette pull-in mechanism 20 when the feeding cassette 3 is inserted into and ejected from the image processing apparatus 1 will be described.

When the feeding cassette 3 is inserted into the image processing apparatus 1, the pin member 32 comes into contact with the edge of the introduction groove 21*i* of the feeding cassette pull-in mechanism 20 and the pin member 32 is introduced into the guide hole 21*h* to penetrate through the guide hole 21*h*. When the pin member 32 is introduced into the guide hole 21*h*, the pin member 32 comes into contact with the pin engagement portion 23*t*. FIG. 3 illustrates a state in which the feeding cassette 3 is inserted into the imaging processing apparatus 1 and immediately before the pin member 32 comes into contact with the lever 23.

When the feeding cassette 3 is further inserted to the rear side from the state illustrated in FIG. 3, the lever 23 is pushed on the second contact surface 23*s* to the rear side by the pin member 32, and thus engagement between the locking portion 22*l* of the cover 22 and the hook 23*h* of the lever 23 is released. The pin member 32 comes into contact with the first contact surface 23*f* of the pin engagement portion 23*t* of the lever 23.

When the engagement between the locking portion 22*l* and the hook 23*h* is released, the elastic member 24 exerts a rotational force in the insertion direction to the lever 23. When the lever 23 is rotated in the insertion direction, the first contact surface 23*f* of the pin engagement portion 23*t* exerts a force in the insertion direction to the pin member 32.

As illustrated in FIG. 3, when the pin member 32 is introduced into the guide hole 21*h*, the guide pin 33 connected to the pin member 32 rides on the rib 21*l* of the edge of the guide hole 21*h*. The roller 33*r* externally fitted in the guide pin 33 is inserted into the groove 21*g* formed in the rib 21*l*.

Figure 4:
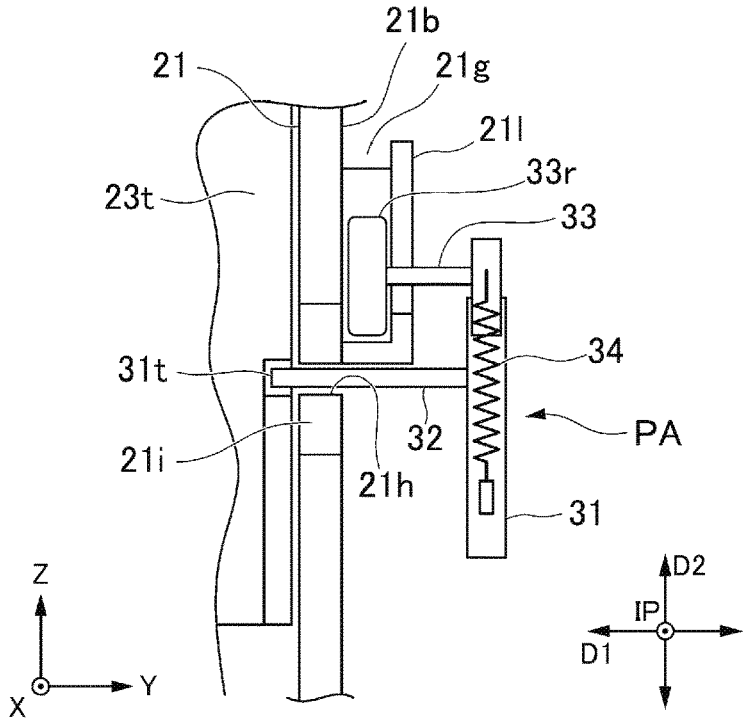
FIG. 4 is a front view illustrating the pull-in end and apart of the feeding cassette pull-in mechanism according to at least one embodiment.

FIG. 4 is a front view illustrating apart of the feeding cassette pull-in mechanism 20 and the pull-in end PA when the guide pin 33 rides on the rib 21*l*. As illustrated in FIG. 4, the roller 33*r* is inserted into the groove 21*g* of the rib 21*l* so that the axial direction is orthogonal to the plate surface 21*b* of the chassis 21. The guide pin 33 internally fitted in the roller 33*r* protrudes to the right side of the rib 21*l* in the right and left direction.

The pin member 32 connected to be rotatable around an axis of the guide pin 33 passes through the guide hole 21*h* of the chassis 21. In the pin member 32, a tip end 31*t* is disposed on the rear side of the plate surface 21*b*. The pin member 32 engages with the pin engagement portion 23*t* of the lever 23.

Figure 5:
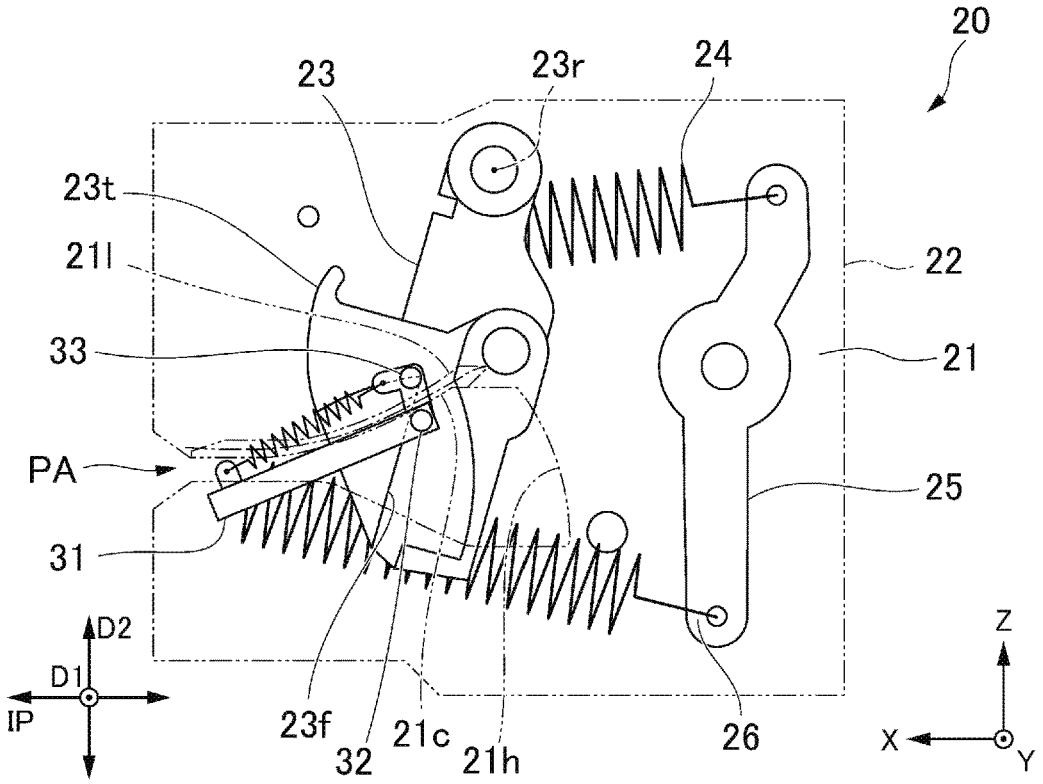
FIG. 5 is a side view illustrating the pull-in end and the feeding cassette pull-in mechanism according to at least one embodiment.

FIG. 5 is a diagram illustrating a state in which the feeding cassette 3 is further inserted to the rear side from the state illustrated in FIG. 3. As illustrated in FIG. 5, the pin member 32 is guided by the guide pin 33 to be moved upwards along the shape of the curved portion 21*c* of the guide hole 21*h*. The pin member 32 is moved upwards to approach the rotation axis 23*r* of the lever 23.

Figure 6:
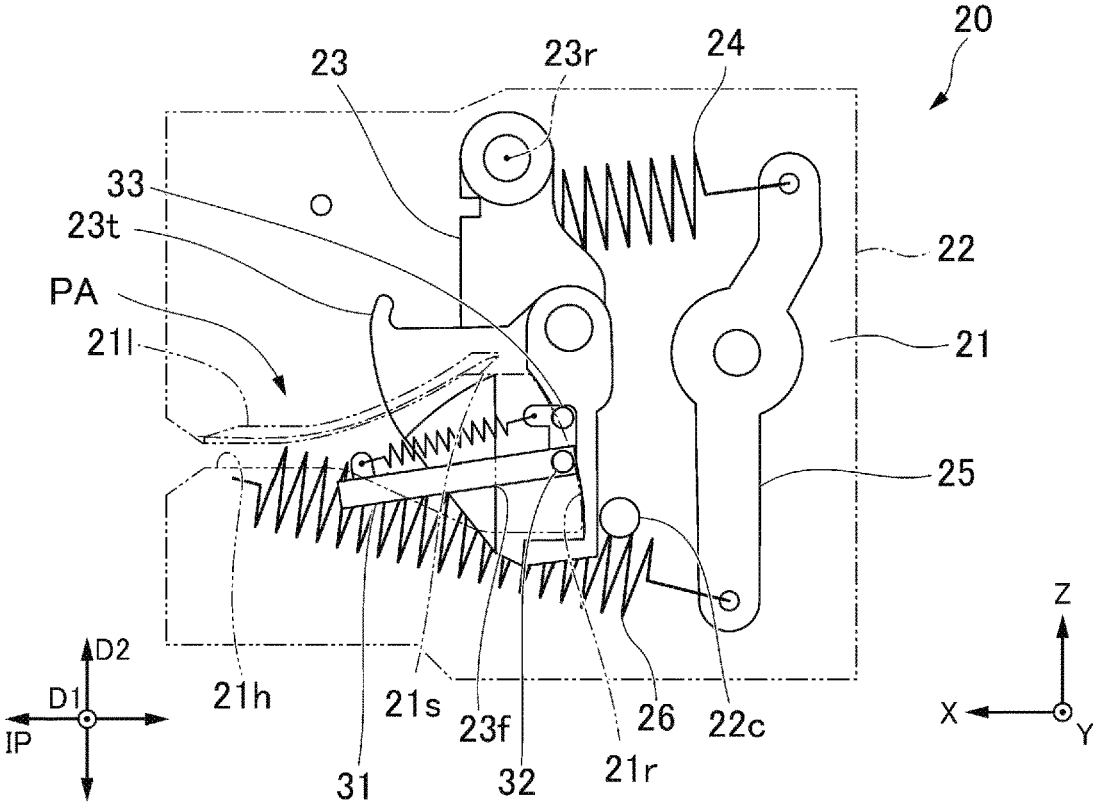
FIG. 6 is a side view illustrating the pull-in end and the feeding cassette pull-in mechanism according to at least one embodiment.

FIG. 6 is a diagram illustrating a state in which the feeding cassette 3 is further inserted to the rear side from the state illustrated in FIG. 5 and the feeding cassette 3 is located at the insertion position I. As illustrated in FIG. 6, the pin member 32 is guided by the guide pin 33 and is moved to the rear side along the shape of the straight portion 21*s* of the guide hole 21*h*. The contact between the guide pin 33 and the rib 21*l* is released. The pin engagement portion 23*t* comes into contact with the contact portion 22*c*, and thus rotation is limited. The tip end 25*t* of the auxiliary lever 25 comes into contact with an inner surface (not illustrated) of the cover 22 on the rear side, and thus rotation of the auxiliary lever 25 is limited.

Figure 7:
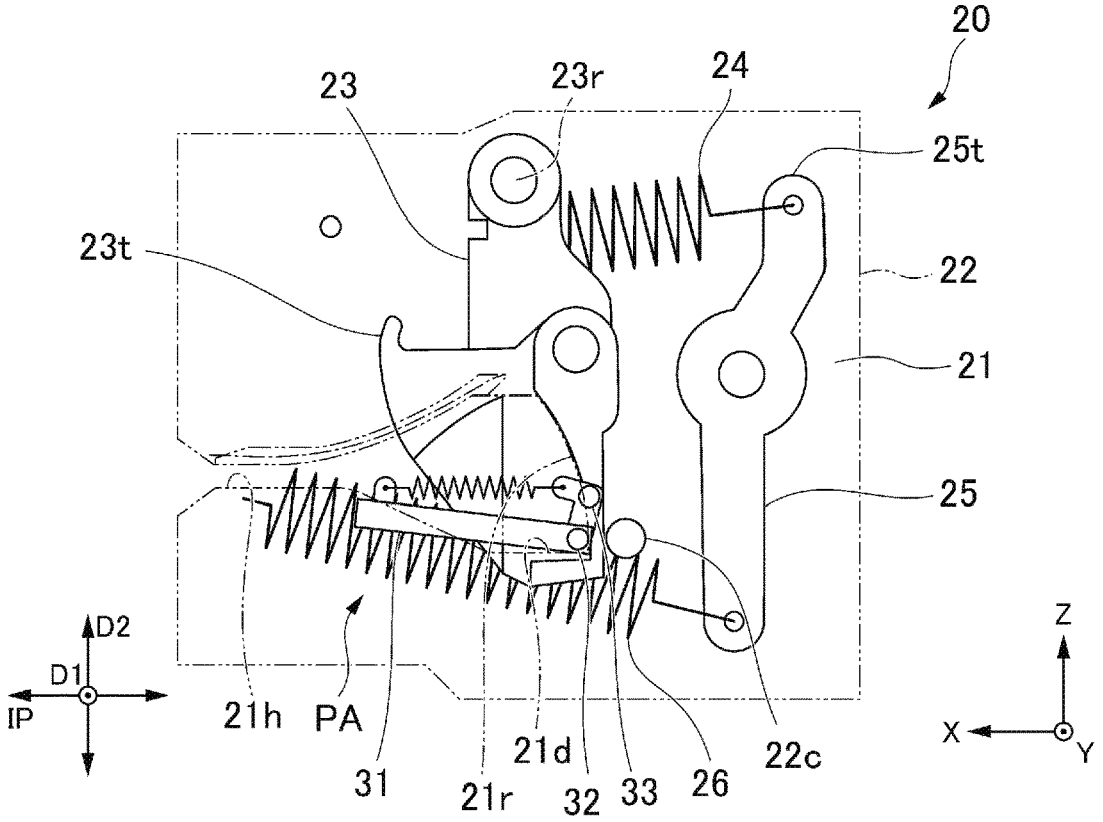
FIG. 7 is a side view illustrating the pull-in end and the feeding cassette pull-in mechanism according to at least one embodiment.

FIG. 7 is a diagram illustrating a state after the state illustrated in FIG. 6. As illustrated in FIG. 7, the pin member 32 is moved downwards by a dead weight while the trajectory is limited by the tip end of the link member 31. The pin member 32 is moved downwards along the shape of the edge 21*r* of the guide hole 21*h* on the rear side. The pin member 32 comes into contact with the lower-side edge 21*d* of the guide hole 21*h*.

Figure 8:
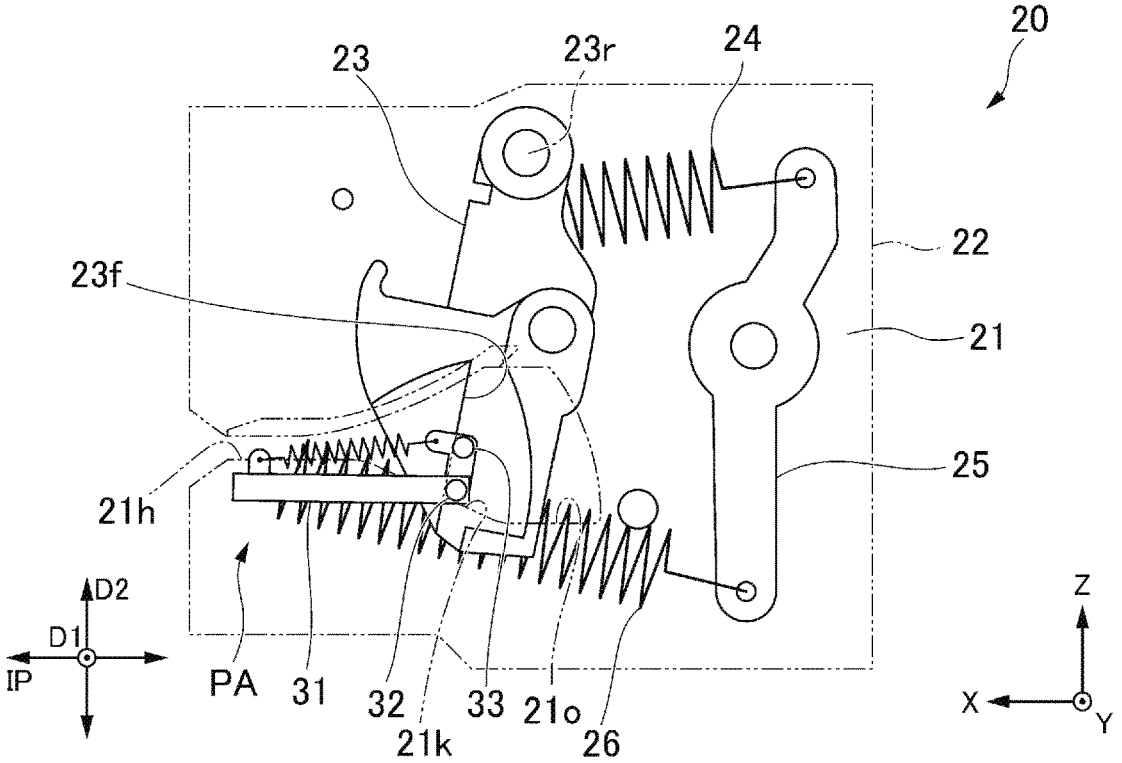
FIG. 8 is a side view illustrating the pull-in end and the feeding cassette pull-in mechanism according to at least one embodiment.

FIG. 8 is a diagram illustrating a state in which the feeding cassette 3 is ejected from the insertion position I from the state illustrated in FIG. 7. As illustrated in FIG. 8, the pin member 32 comes into contact with the first contact surface 23*f* of the pin engagement portion 23*t*. The first contact surface 23*f* exerts a force in an insertion direction to the pin member 32. The pin member 32 moves along the inclined portion 21*k* after the pin member 32 moves along the first straight portion 21*o* of the lower-side edge 21*d* of the guide hole 21*h*.

Figure 9:
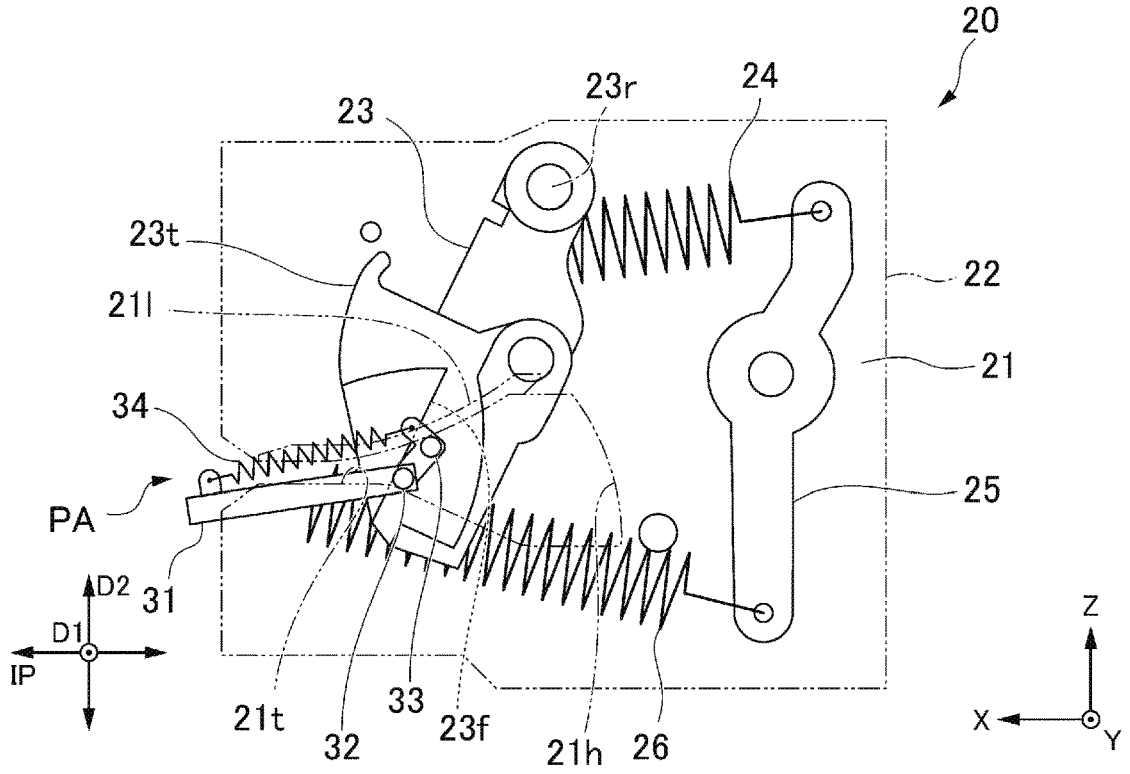
FIG. 9 is a side view illustrating the pull-in end and the feeding cassette pull-in mechanism according to at least one embodiment.

FIG. 9 is a diagram illustrating a state in which the feeding cassette 3 is further ejected to the front side from the state illustrated in FIG. 8. As illustrated in FIG. 9, the pin member 32 moves along the second straight portion 21*t* of the lower-side edge 21*d* of the guide hole 21*h*. The guide pin 33 comes into contact with the rib 21*l* to rotate and follow with respect to the pin member 32.

Figure 10:
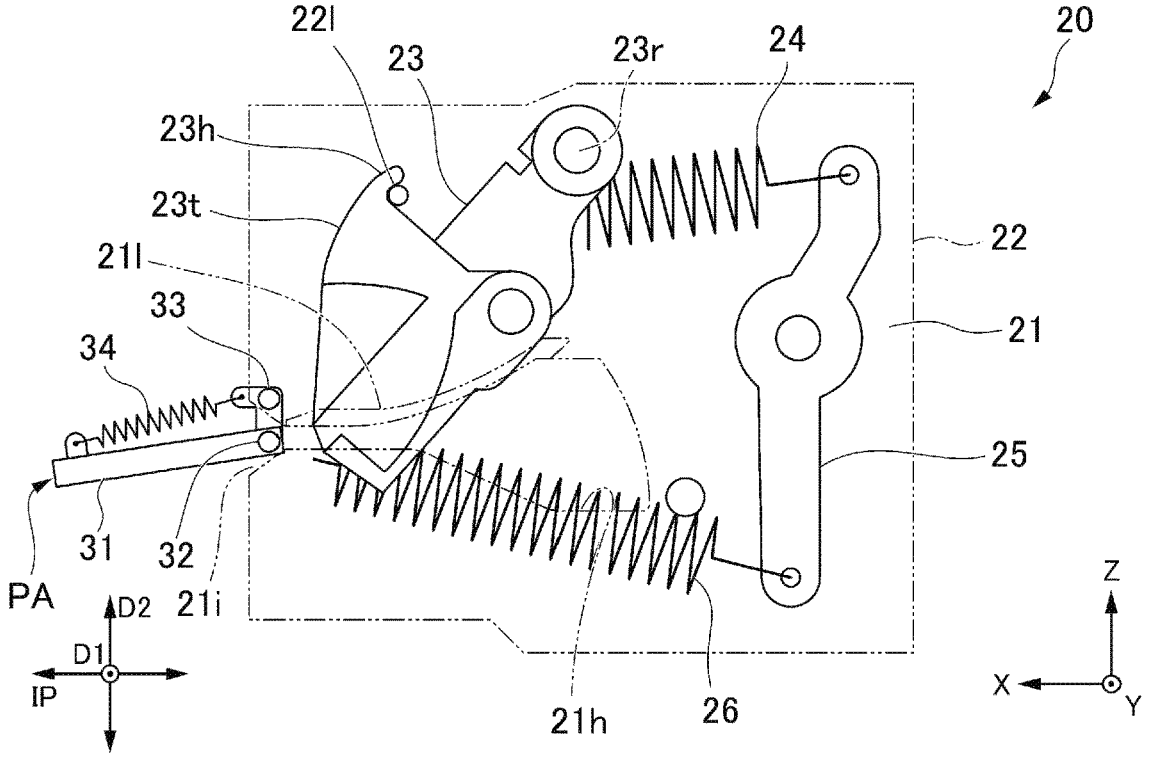
FIG. 10 is a side view illustrating the pull-in end and the feeding cassette pull-in mechanism according to at least one embodiment.

FIG. 10 is a diagram illustrating a state in which the feeding cassette 3 is further ejected to the front side from the state illustrated in FIG. 9 and the pin member 32 is introduced to the introduction groove 21*i* of the feeding cassette pull-in mechanism 20. As illustrated in FIG. 10, the engagement between the pin member 32 and the pin engagement portion 23*t* of the lever 23 is released. The guide pin 33 releases contact with the rib 21*l* and the urging member 24 urges the guide pin 33 to return to its original position with respect to the pin member 32.

The pin member 32 circles the edge of the guide hole 21*h* once (e.g., completes one cycle of movement) in the series of operations of inserting and ejecting the feeding cassette 3 into and from the body of the image processing apparatus 1.

Figure 11:
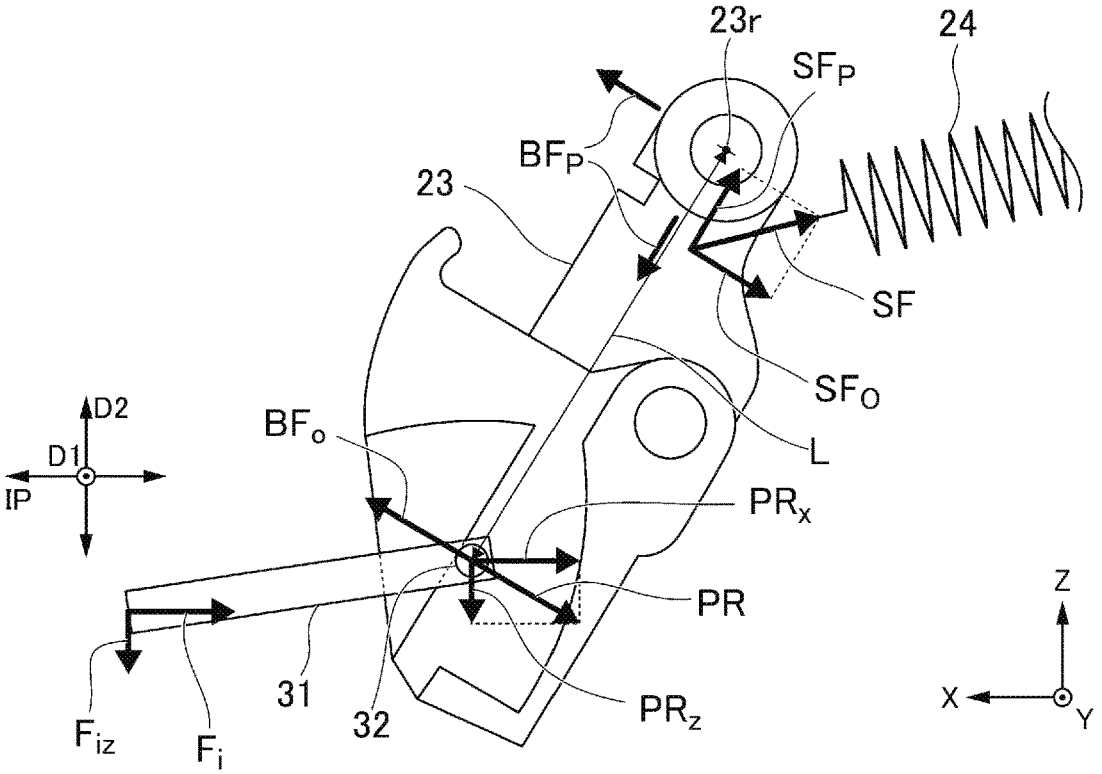
FIG. 11 is a diagram illustrating a relation between forces applied to a lever, a pin member, and a link member included in the image processing apparatus according to at least one embodiment.
Figure 12:
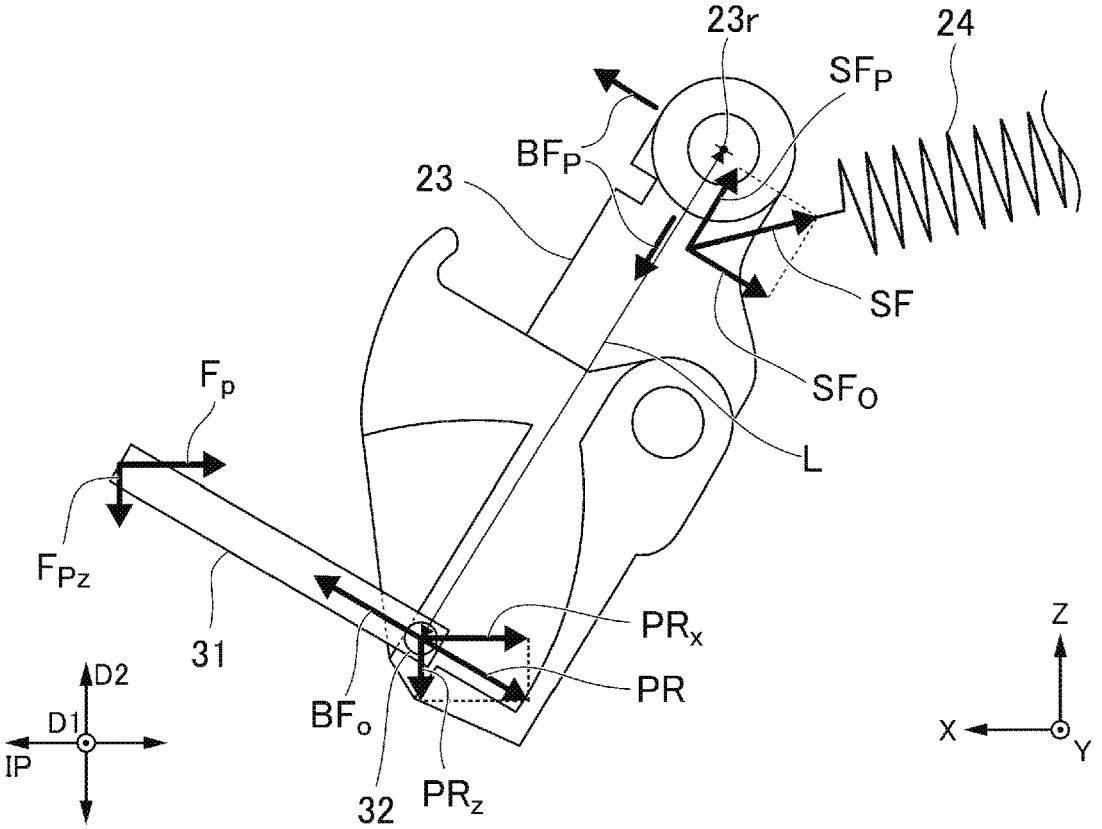
FIG. 12 is a diagram illustrating a relation between the forces applied to the lever, the pin member, and the link member according to at least one embodiment.

FIG. 11 is a diagram illustrating a force applied to the lever 23, the pin member 32, and the link member 31 when the feeding cassette 3 is inserted into the apparatus body 15. FIG. 12 is a diagram illustrating a force applied to the lever 23, the pin member 32, and the link member 31 when the feeding cassette 3 is ejected from the apparatus body 15. In FIGS. 11 and 12, the position of the pin member 32 in the insertion and ejection direction IP are the same.

As illustrated in FIGS. 11 and 12, the elastic member 24 exerts a force SF on the lever 23 causing the lever 23 to rotate around the rotation axis 23*r* with angular momentum, e.g., by exerting torque on the lever 23. The lever 23 receives forces BFp and BFo which balance with the force SF and the angular momentum from rotation about the rotation axis 23*r* and the pin member 32.

The pin member 32 receives a force PR with the same magnitude as the force BFo as a reaction force of the force BFo added to the lever 23. As illustrated in FIG. 11, when the feeding cassette 3 is inserted into the apparatus body 15, a force Fi in the insertion direction and with the same magnitude as a force PRx of an insertion direction component of the force PR added to the pin member 32 is added to the feeding cassette 3 via the link member 31.

As illustrated in FIG. 12, when the feeding cassette 3 is ejected from the apparatus body 15, a force Fp in the insertion direction and with the same magnitude as the force PRx of the insertion direction component of the force PR added to the pin member 32 is added to the feeding cassette 3 via the link member 31.

When the position of the pin member 32 in the insertion and ejection direction IP is the same and the feeding cassette 3 is inserted into the apparatus body 15, the pin member 32 is disposed on the upper side more than when the feeding cassette 3 is ejected from the apparatus body 15. Therefore, when the feeding cassette 3 is inserted into the apparatus body 15, a distance L between the pin member 32 and the rotation axis 23*r* of the lever 23 is shorter than when the feeding cassette 3 is ejected from the apparatus body 15.

Therefore, when the position of the pin member 32 in the insertion and ejection direction IP is the same position and the feeding cassette 3 is ejected from the apparatus body 15, a force in the insertion direction received from the lever 23 by the pin member 32 is less than when the feeding cassette 3 is inserted into the apparatus body 15. Therefore, the force Fp is less than the force Fi.

Figure 13:
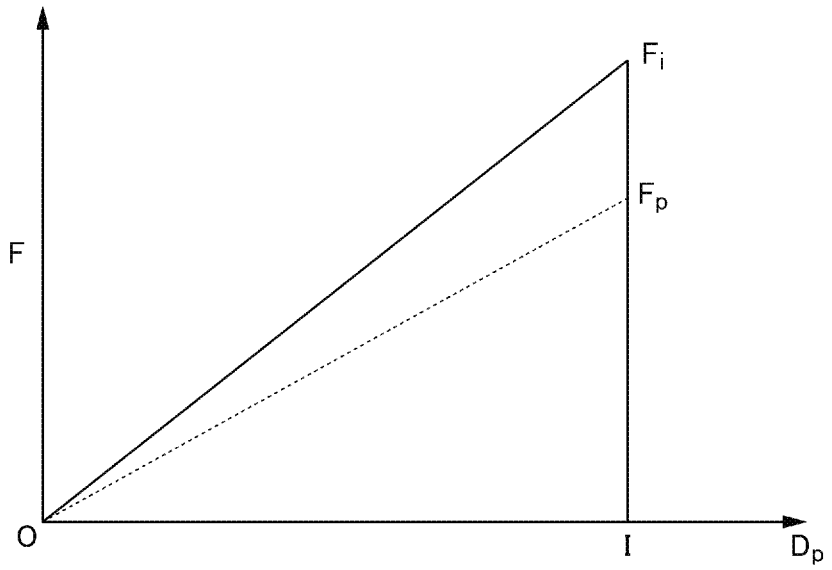
FIG. 13 is a diagram illustrating a force applied to a feeding cassette included in the image processing apparatus according to at least one embodiment.

FIG. 13 is a diagram in which the horizontal axis represents a depth Dp at which the pin member 32 is inserted into the apparatus body 15, an origin O represents a position at which contact of the feeding cassette pull-in mechanism 20 with the pin engagement portion 23*t* starts, and I represents the insertion position I. FIG. 13 is a diagram in which the vertical axis represents magnitude of a force in the insertion direction which is added by the feeding cassette pull-in mechanism 20 to the feeding cassette 3.

As illustrated in FIG. 13, a force F added to the feeding cassette 3 increases as the depth Dp increases. As illustrated in FIG. 13, a slope of a curve of the force Fp when the feeding cassette 3 is ejected from the apparatus body 15 is less than a slope of a curve of the force Fi when the feeding cassette 3 is inserted into the apparatus body 15. Therefore, as illustrated in FIG. 13, when the depth Dp is constant, the magnitude of the force Fp when the feeding cassette 3 is ejected from the apparatus body 15 is equal to or less than the magnitude of the force Fi when the feeding cassette 3 is inserted into the apparatus body 15.

In the image processing apparatus 1 according to at least one embodiment, the lever 23 of the feeding cassette pull-in mechanism 20 provided in the apparatus body 15 comes into contact with the pin member 32 connected to the feeding cassette 3 to add the force in the insertion direction. With regard to the lever 23 urged to rotate to the rear side, the pin member 32 is closer to the rotation axis 23*r* of the lever 23 when the feeding cassette 3 is ejected than when the feeding cassette 3 is inserted. When the feeding cassette 3 is ejected, the force in the insertion direction added to the pin member 32 is less than when the feeding cassette 3 is inserted.

Therefore, in the image processing apparatus 1, the force in the insertion direction is applied to the feeding cassette 3. When the feeding cassette 3 is ejected, the force in the insertion direction applied to the feeding cassette 3 is less than when the feeding cassette 3 is inserted. Therefore, in the image processing apparatus 1, when a user ejects the feeding cassette 3, the force in the insertion direction applied to the feeding cassette 3 is reduced, and thus a load on the user is reduced.

In the image processing apparatus, the auxiliary lever 25 and the auxiliary elastic member 26 may not be provided when there is a space in which stretch of the elastic member 24 necessary to generate an appropriate tensile strength can be secured. When the auxiliary lever 25 and the auxiliary elastic member 26 are not provided, the base end 24*p* of the elastic member 24 is connected directly to the chassis 21 or the cover 22.

In the image processing apparatus 1, the insertion and ejection direction is the depth direction, the first direction is the right and left direction, and the second direction is the upper and lower direction. In the image processing apparatus, the first direction may be the upper and lower direction and the second direction may be the right and left direction in the horizontal direction. In the image processing apparatus, the insertion and ejection direction may be the right and left direction and the first direction may be the depth direction. In the image processing apparatus, the insertion and ejection direction may be the right and left direction, the first direction may be the upper and lower direction, and the second direction may be the depth direction.

In the image processing apparatus, the insertion and ejection direction may not be orthogonal to the first and second directions as long as not to be parallel to the first or second direction.

According to at least one of the above-described embodiments, when the user ejects the feeding cassette 3, the force in the insertion direction applied to the feeding cassette 3 is reduced, and thus the load on the user is reduced.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image processing apparatus comprising:

an apparatus body;

a feeding cassette configured to be insertable into the apparatus body in an insertion direction and ejectable from the apparatus body in an ejection direction, the feeding cassette having an insertion position at which the feeding cassette is insertable into the apparatus body and an ejection position at which the feeding cassette is ejectable from the apparatus body;

a pin member having an axis orthogonal to the insertion and ejection directions and configured to connect to the feeding cassette in a first direction orthogonal to the insertion and ejection directions, the pin member being relatively movable in a second direction orthogonal to the insertion and ejection directions and the first direction;

a lever configured to rotate about a rotational axis parallel to the first direction, and configured to include a pin engagement portion configured to engage with the pin member at a tip end of the lever in an axial direction of the lever, the pin engagement portion including a first contact surface in the ejection direction;

an elastic member configured such that a tip end of the elastic member in an axial direction of the elastic member is connected between the rotational axis of the lever and the pin engagement portion of the lever, the elastic member configured to:

exert rotational force in the insertion direction to the pin engagement portion of the lever, and bring the pin member into contact with the first contact surface of the lever to exert force in the insertion direction on the pin member; and a guide mechanism configured to shorten a distance between the pin member and the rotational axis of the lever at a time when the feeding cassette transitions from the ejection position to the insertion position so as to be less than a distance at a time when the feeding cassette transitions from the insertion position to the ejection position, the guide mechanism including a chassis connected to the apparatus body, the chassis formed in a substantially planar shape, and including a plate surface orthogonal to the first direction, a guide hole formed in the chassis, the chassis configured to allow the pin member to penetrate through the guide hole, and travel along an edge of the guide hole at least during inserting the feeding cassette into the apparatus body and during ejecting the feeding cassette from the apparatus body, and a rib disposed at the edge of the guide hole; and a guide pin connected to the pin member and configured to come into contact with the rib to guide the pin member along the edge of the guide hole.

2. The image processing apparatus according to claim 1, wherein a dimension of the guide hole in the second direction is not constant.

3. The image processing apparatus according to claim 1, wherein the guide pin is configured to:

rotate about the axis of the pin member;

guide the pin member along the rib when the feeding cassette is inserted into the apparatus body; and follow the pin member when the feeding cassette is ejected from the apparatus body.

4. The image processing apparatus according to claim 1, further comprising:

a groove formed in the rib; and a roller connected to the guide pin and inserted into the groove.

5. The image processing apparatus according to claim 1, wherein the feeding cassette is configured to store at least one sheet stacked in the second direction.

6. The image processing apparatus according to claim 1, wherein the second direction is oriented in a horizontal direction.

7. The image processing apparatus according to claim 2, wherein the dimension of the guide hole in the second direction increases in the insertion direction.

8. The image processing apparatus according to claim 1, further comprising:

an auxiliary lever configured to rotate about a rotational axis in the first direction, and configured such that a base end of the elastic member is connected to a tip end of the auxiliary lever in an axial direction of the auxiliary lever; and an auxiliary elastic member configured such that a tip end of the auxiliary elastic member in an axial direction of the auxiliary elastic member is connected to a base end of the auxiliary lever, and configured to exert force on the base end of the auxiliary lever in the ejection direction.

* * * * *